US005680722A

United States Patent [19]

French et al.

[11] Patent Number: 5,680,722

[45] Date of Patent: Oct. 28, 1997

[54] FIRE CONTROL SYSTEM FOR FIREARMS

[75] Inventors: Kendrick L. French, Lebanon, Me.; Mark C. Laney, Lee, N.H.

[73] Assignee: Thompson Intellectual Properties, Ltd., Rochester, N.H.

[21] Appl. No.: 668,913

[22] Filed: Jun. 24, 1996

[51] Int. Cl.[6] ..... F41A 3/00

[52] U.S. Cl. ..... 42/69.03; 42/69.01; 42/70.04; 42/70.01; 42/70.08; 42/66; 42/43; 42/44; 42/41; 42/8; 42/20

[58] Field of Search ..... 42/69.03, 69.01, 42/70.04, 70.01, 70.08, 66, 43, 44, 41, 8, 20; 89/164

[56] References Cited

U.S. PATENT DOCUMENTS

| | | | |
|---|---|---|---|
| 600,337 | 3/1898 | Richardson | 42/66 |
| 609,233 | 8/1898 | Houghton | 42/66 |
| 811,807 | 2/1906 | Wesson | 42/65 |
| 835,380 | 11/1906 | Wesson et al. | 42/66 |
| 855,227 | 5/1907 | Bull | 42/65 |
| 1,070,145 | 8/1913 | Lewis | 42/69.01 |
| 1,297,859 | 3/1919 | Johnson | 42/69.01 |
| 1,405,765 | 2/1922 | Diehm | 42/20 |
| 2,758,404 | 8/1956 | Tabor | 42/69 |
| 2,832,167 | 4/1958 | Fox | 42/75 |
| 3,988,848 | 11/1976 | Chatigny | 42/70 F |
| 4,307,530 | 12/1981 | Melcher et al. | 42/67 |
| 4,384,422 | 5/1983 | Roh | 42/65 |
| 4,449,312 | 5/1984 | Ruaer et al. | 42/66 |
| 4,516,466 | 5/1985 | Jennie | 89/145 |
| 4,621,445 | 11/1986 | Rohm | 42/66 |
| 4,646,457 | 3/1987 | Verney-Carron | 42/41 |
| 4,841,840 | 6/1989 | Agner et al. | 89/154 |
| 4,854,065 | 8/1989 | French et al. | 42/65 |
| 5,095,643 | 3/1992 | Fisher | 42/44 |
| 5,421,114 | 6/1995 | Bond et al. | 42/42.03 |
| 5,519,956 | 5/1996 | Howell | 42/70.08 |

FOREIGN PATENT DOCUMENTS 588225 5/1925 France .

*Primary Examiner*—Charles T. Jordan
*Assistant Examiner*—Meena Chelliah
*Attorney, Agent, or Firm*—Blodgett & Blodgett, P.C.

[57] ABSTRACT

A firearm having a trigger which is pivoted to the frame, a hammer which is pivoted to the frame and biased in a forward position, a barrel which is pivotally mounted on the frame so that the breech end of the barrel can be moved between a closed position and an open position. A latch is operatively connected to the hammer and to the trigger for positioning the trigger in its cocked position when the hammer is in its cocked position and for releasably maintaining the hammer in its cocked position, and for releasing the hammer to its firing position upon manual actuation of the trigger. A first locking means is operatively connected to the barrel for preventing the barrel from moving to its open position when the hammer is in its cocked position. A second locking means is operatively connected to the barrel and to the hammer for preventing the hammer from moving to its cocked position when the barrel is in its open position. More specifically, the latch functions as a sear between the hammer and the trigger for releasing the hammer upon actuation by the trigger. The latch also functions as a hammer block for maintaining the hammer in a neutral position which is between its cocked position and its firing position.

28 Claims, 12 Drawing Sheets

FIRE CONTROL SYSTEM FOR FIREARMS

BACKGROUND OF THE INVENTION

The present invention relates in general to a firearm in which the barrel is pivotally mounted on the frame from a closed firing position to an open loading position for exposing the receiver in the breech end of the barrel. This enables a cartridge to be inserted into the receiver of the barrel where upon the barrel is returned to its closed position. Firing of the firearm is initiated by, first, manually cocking a hammer to a cocked position. The hammer is operatively connected to a trigger mechanism. The firearm is discharged by manually pulling back on the trigger. This releases the hammer to the firing position, whereupon the hammer strikes a firing pin which, in turn, strikes the cartridge. The invention is particularly directed to a firearm in which a hammer block is employed to prevent the hammer from moving to its firing position, except when the trigger is manually actuated.

In a typical firearm which utilizes a hammer block, the hammer block remains in a blocking position when the hammer alone is actuated. The hammer block is moved from its blocking position through the action of the trigger mechanism. In some other firearms, a transfer plate is used in place of the hammer block. In such a firearm, the hammer is incapable of striking a percussion element or a cartridge in its extreme forward position. The transfer plate is imposed between the percussion element or cartridge and the hammer by the action of the trigger mechanism. The mechanism for activating the hammer block or transfer plate for each firearm involves a complicated lever and linkage arrangement. In other firearms, the interconnection between the hammer and the trigger is simplified at the cost of adding tension to the trigger, thereby making it difficult to release the trigger for firing. In cases where great accuracy is required, as in target shooting or hunting, a hard trigger pull is detrimental to accuracy. Most marksman require some tension but not too much. The exact amount of tension varies from one marksman to another. The general consensus amongst marksmen is that a trigger should have a firing tension or "pull" tension of between three and four pounds. A marksman prefers to be able to squeeze the trigger to discharge the firearm rather than having to jerk the trigger back to discharge the firearm. If a "pull" tension is more than the marksman feels comfortable with, he or she has a tendency to jerk the firearm with a resulting loss of accuracy. Another problem encountered with many firearms is that the hammer can be cocked when the breech end of the barrel is in the open position or the breech end of the barrel can be moved to the open position while the hammer is cocked. The firearm cannot be discharged if the breech end of the barrel is in the open position, since the cartridge and the hammer are separated. However, accidental discharge of the firearm is possible when the breech end of the barrel is returned to its closed position with the hammer in the cocked position, assuming that there is a cartridge in the receiver of the barrel. These and other difficulties experienced with the prior art firearms have been obviated by the present invention.

It is, therefore, a principle object of the invention to provide a firearm which provides a latch connection between the hammer and the trigger which enables the hammer to be released from the cocked position to the firing position by actuation of the trigger and by functioning as a hammer block when the hammer is not in the cocked position.

Another object of this invention is the provision of a firearm which employs a latch mechanism for operatively connecting the hammer block to the trigger which also functions as a sear and a hammer block.

A further object of the present invention is a provision of a latch mechanism for operatively connecting the hammer to the trigger and which provides an optimum pulling tension to the trigger for greater firing accuracy.

It is another object of the present invention to provide a firearm in which the hammer is prevented from being moved to its cocked position while the breech end of the barrel is in the open position.

A still further object of the invention is the provision of a firearm, wherein the breech end of the barrel is prevented from moving to its open position when the hammer is in its cocked position.

With these and other objects in view, as will be apparent to those skilled in the art, the invention resides in the combination of parts set forth in the specification.

SUMMARY OF THE INVENTION

In general, the invention consists of a firearm having a trigger which is pivoted to the frame, a hammer which is pivoted to the frame and biased in a forward position, a barrel which is pivotally mounted on the frame so that the breech end of the barrel can be moved between a closed position and an open position. A latch is operatively connected to the hammer and to the trigger for positioning the trigger in its cocked position when the hammer is in its cocked position and for releasably maintaining the hammer in its cocked position, and for releasing the hammer to its firing position upon manual actuation of the trigger. A first locking means is operatively connected to the barrel for preventing the barrel from moving to its open position when the hammer is in its cocked position. A second locking means is operatively connected to the barrel and to the hammer for preventing the hammer from moving to its cocked position when the barrel is in its open position. More specifically, the latch functions as a sear between the hammer and the trigger for releasing the hammer upon actuation by the trigger. The latch also functions as a hammer block for maintaining the hammer in a neutral position which is between its cocked position and its firing position.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 9:
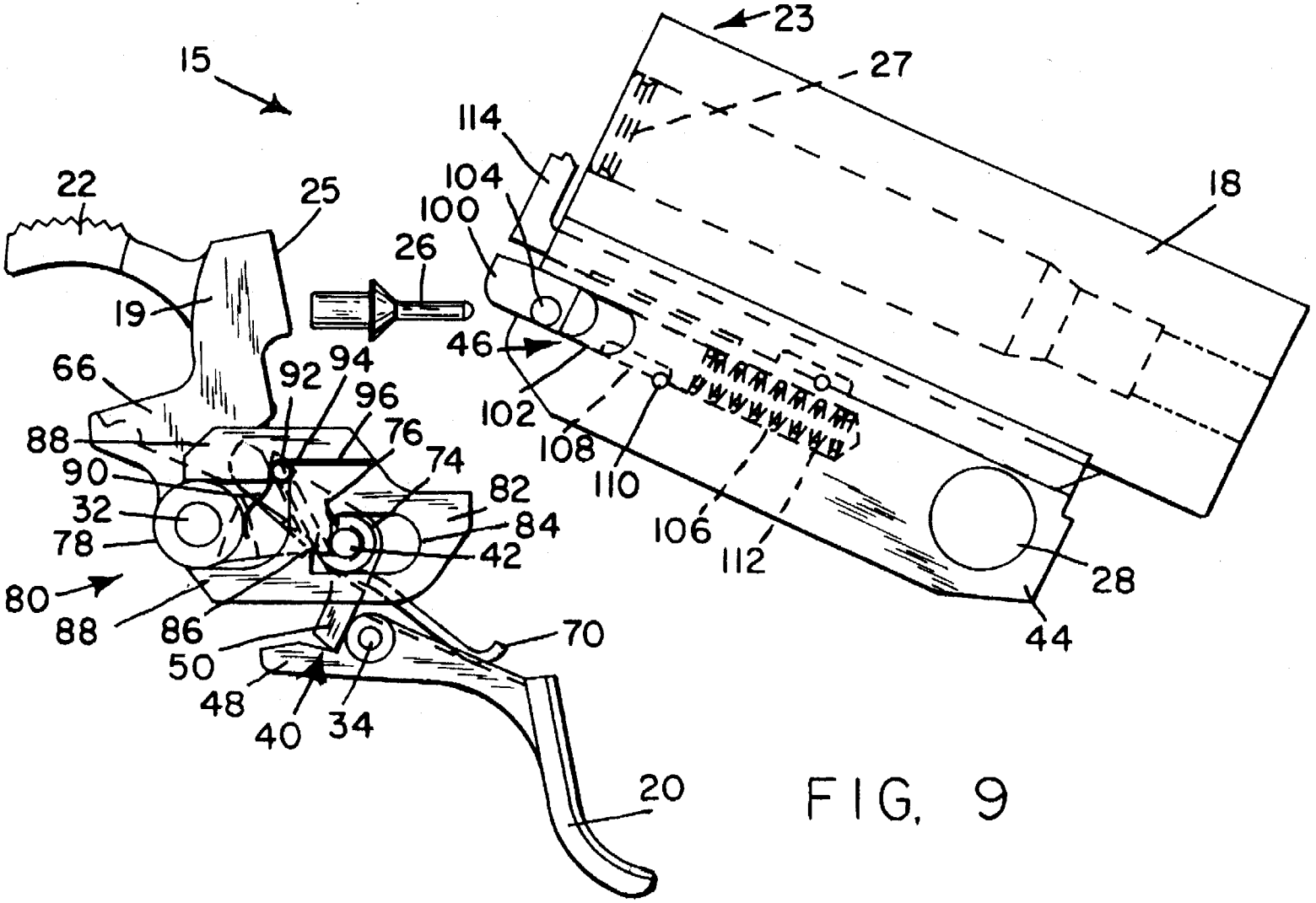
FIG. 9 is a view similar to FIG. 8, showing the barrel in its open position, the hammer and trigger in their neutral positions and the interlock system in the engaged position.

Referring first to FIGS. 1–4, the firearm of the present invention is generally indicated by the reference numeral 15 and includes a frame 16, a hand grip 17, a barrel 18, a hammer 19, a trigger 20, and a trigger housing 21. The barrel 18 has a muzzle end, generally indicated by the reference numeral 24, and breech end, generally indicated by the reference numeral 23. The barrel 18 is pivotally mounted on the frame 16 about a pivot pin 28 for movement between a closed position, shown in FIGS. 2 and 4, and an open position, shown in FIG. 9. When the barrel 18 is in the open position, as shown in FIG. 9, a receiver at the breech end of the barrel is exposed for receiving a cartridge.

Figure 1:
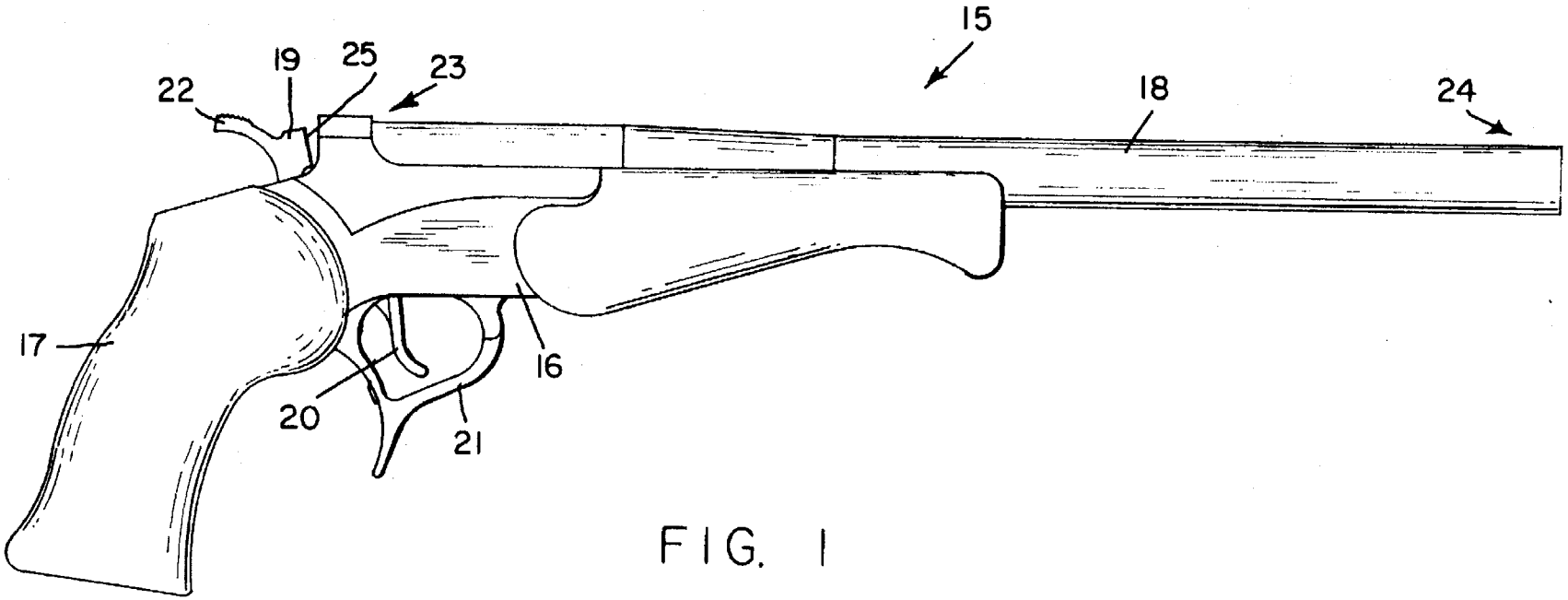
FIG. 1 is a side elevational view of a firearm embodying the principles of the present invention.
Figure 2:
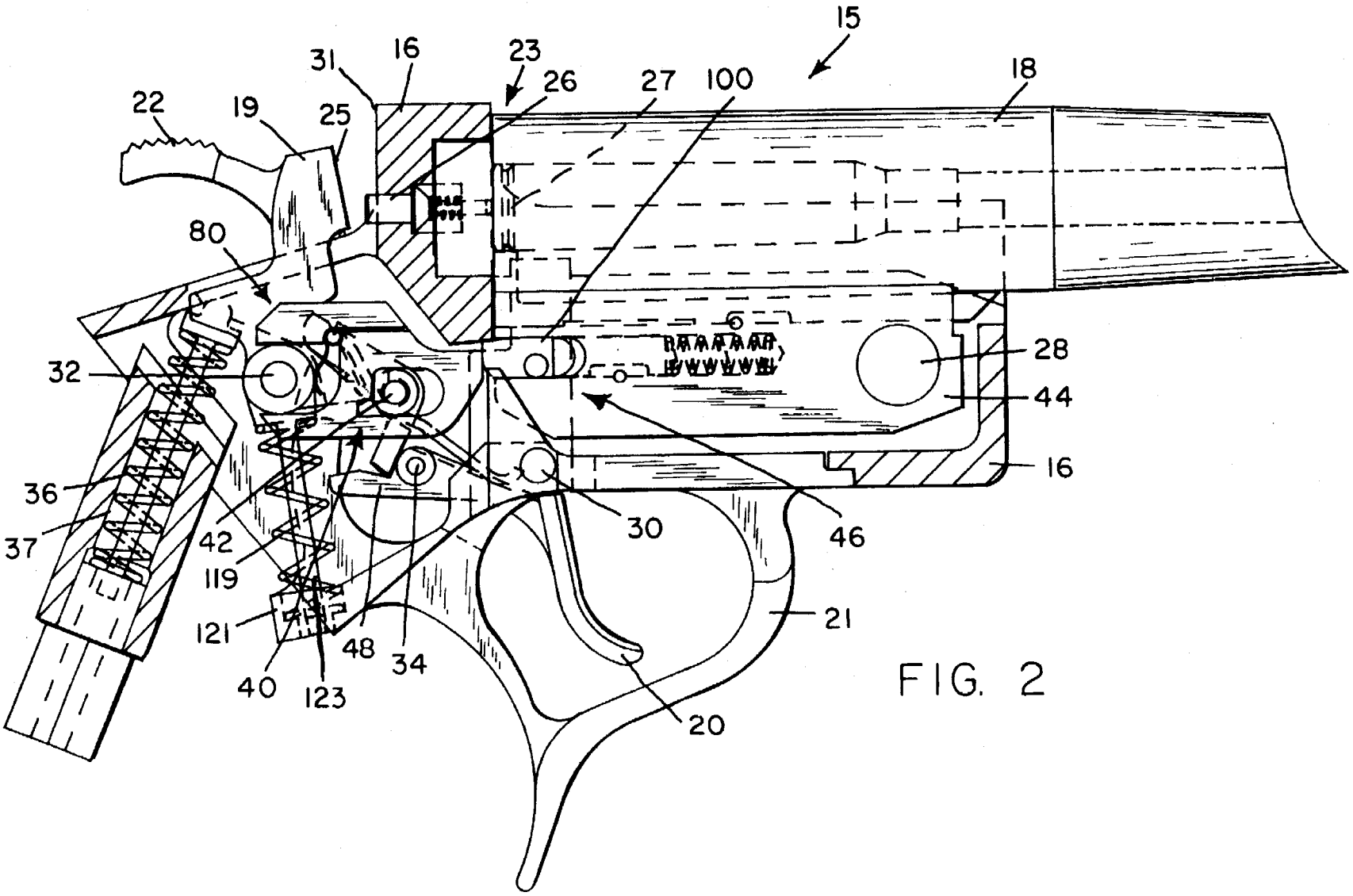
FIG. 2 is a fragmentary side elevational view of the firearm with portions broken away and showing the hammer in the neutral position.
Figure 3:
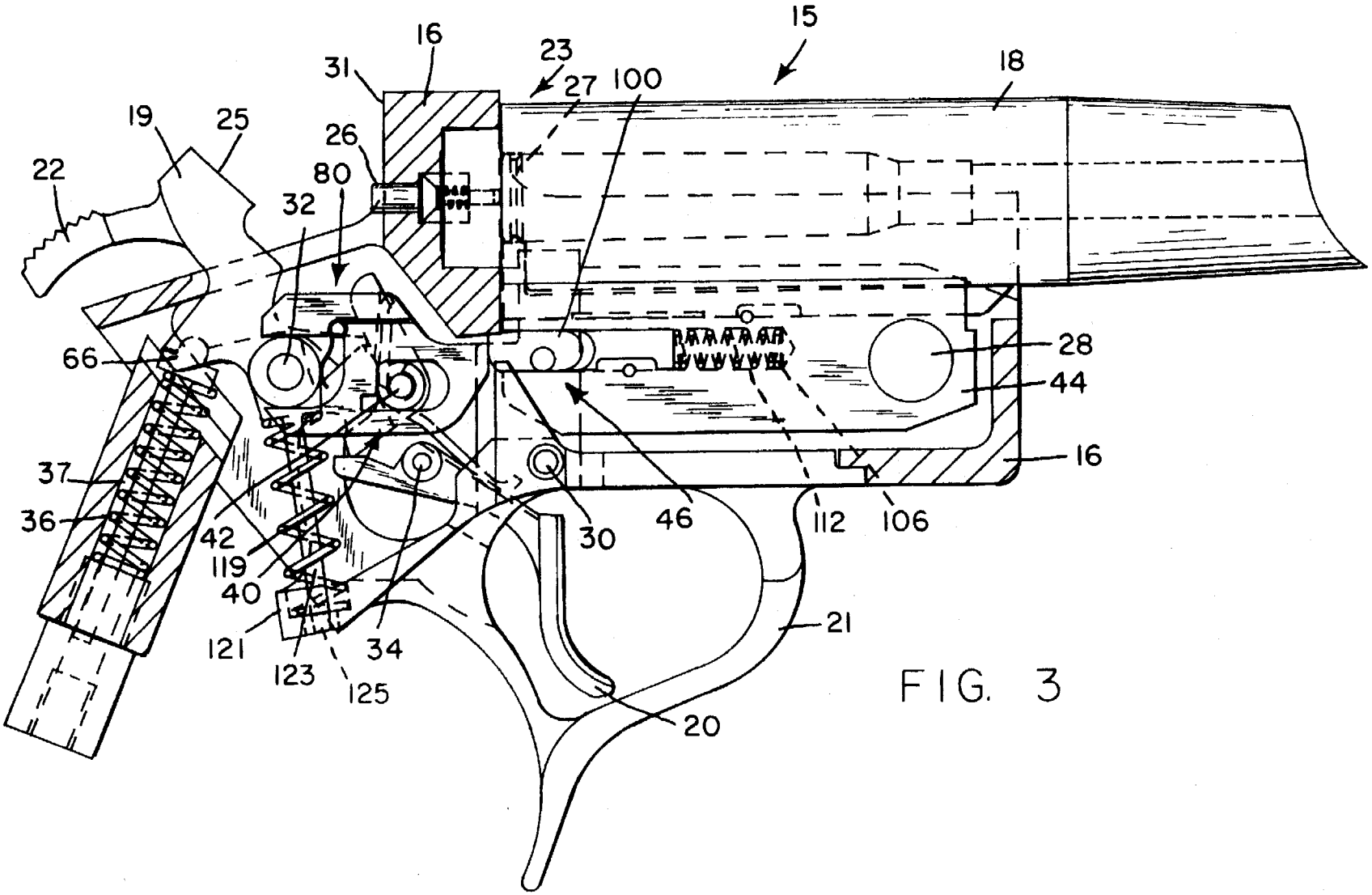
FIG. 3 is a view similar to FIG. 2 showing the hammer and trigger in the cocked position.
Figure 4:
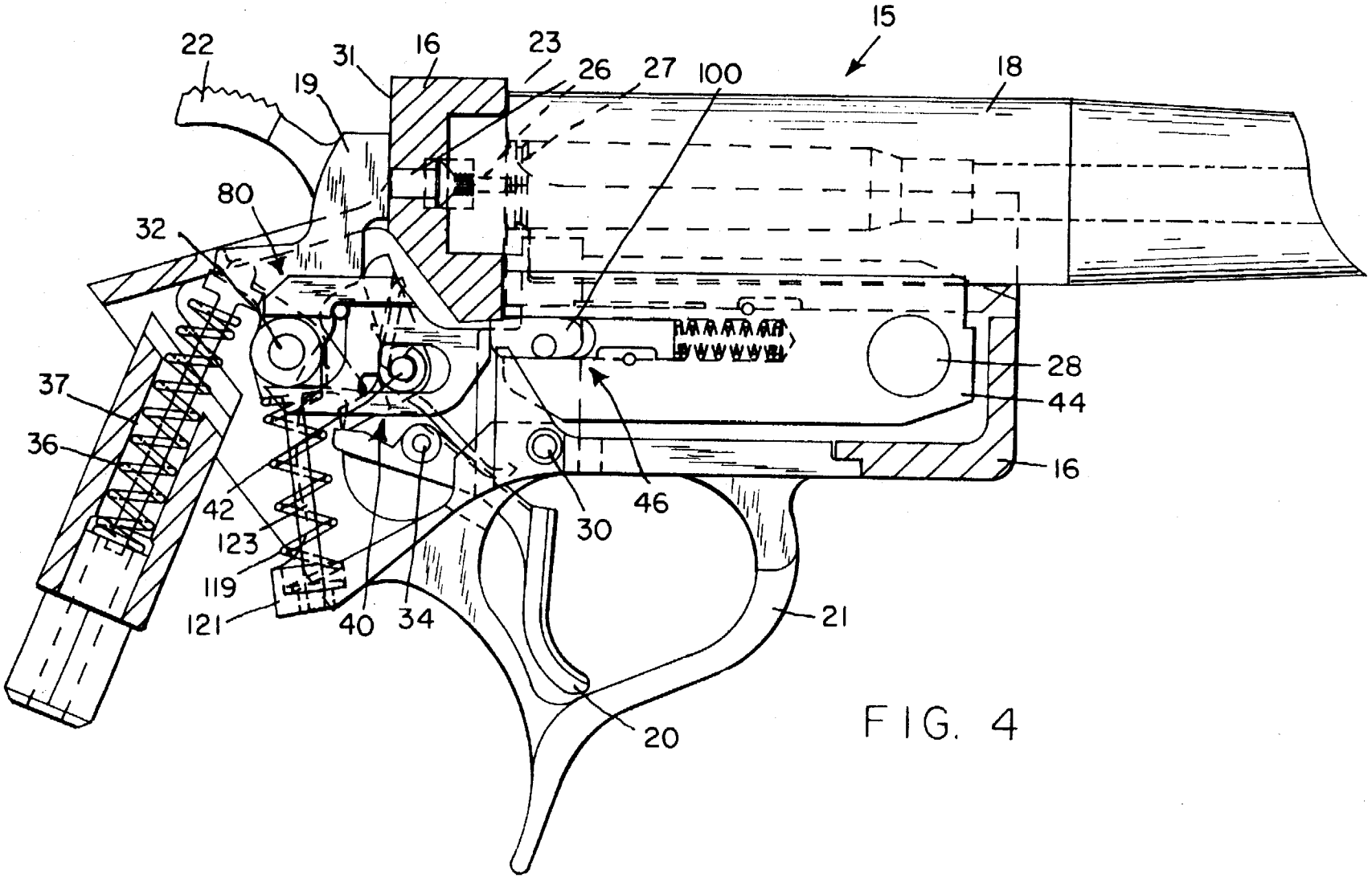
FIG. 4 is view similar to FIG. showing the hammer and trigger in the firing position.

The hammer 19 has a forwardly facing striker surface 25 and is pivotally mounted on horizontal pivot pin 32 which is, in turn, supported on the frame 16. The hammer 19 has a thumb grip 22 for enabling the hammer to be moved manually about the pivot pin 32 from a neutral position, shown in FIG. 2, to a cocked position, shown in FIG. 3. When the hammer is released, it moves from its cocked position, shown in FIG. 3, to its firing position, shown in FIG. 4. A firing pin 26 is slidably mounted along its central longitudinal axis within the frame 16. The firing pin 26 is in axial alignment with the bore of the barrel 18 and the striker surface 25 of the hammer 19 when the barrel is in the closed position. The firing pin 26 is biased rearwardly by a spring 29 so that the rearward end of the firing pin extends beyond the rearward surface 31 of the frame, as shown in FIG. 2, and the forward portion of the pin 26 extends forwardly to the receiver 27. When the hammer 19 reaches the firing position as shown in FIG. 4, the striker surface 25 strikes the rearward end of the firing pin 26 and pushes the forward end of the firing pin into the receiver 27. The sharp movement of the firing pin 26 into the receiver 27 enables the firing pin to strike the primer of a cartridge which is positioned within the receiver for discharging the cartridge. The hammer 19 is biased to the firing position by a compression spring 36 which is guided within a bore 37 in the frame 16.

The trigger guard 21 is pivotally mounted on a horizontal pin 30 which is supported on the frame 16. The trigger 20 is pivotally mounted on a horizontal pin 34 which is supported on the frame 16. The trigger 20 is operatively connected to the hammer 19 through a latch which is generally indicated by the reference numeral 40. The latch 40 is mounted on a horizontal pivot pin 42 which is supported on the frame 16. The barrel 18 is maintained in the closed position by means of a releasable catch mechanism, generally indicated by the reference numeral 46. The releasable catch mechanism 46 is located in a subhousing 44 which is fixed to the underside of the barrel 18 near the breech end of the barrel. The pivot pin 28 is also located within the subhousing 44.

Figure 5:
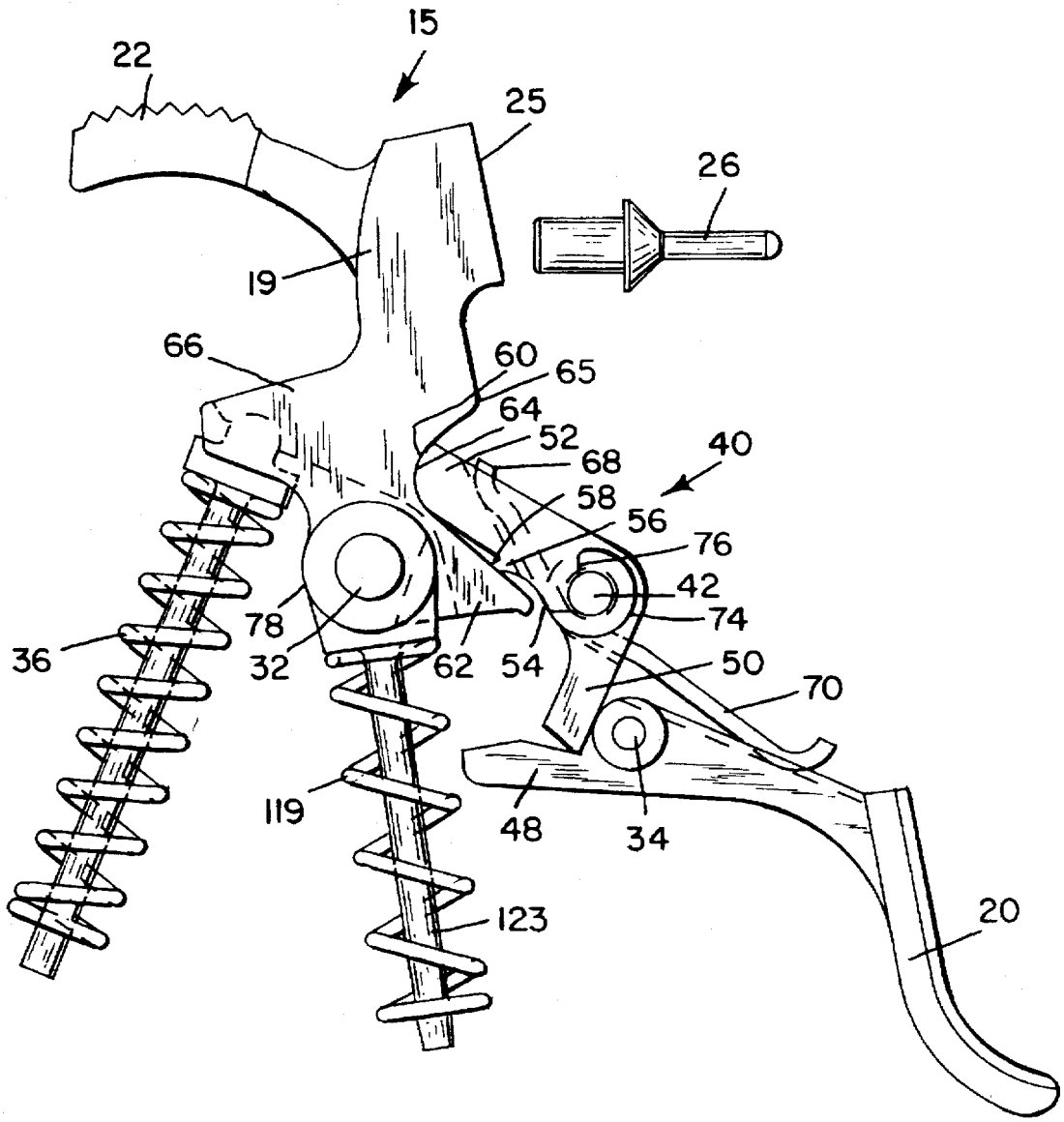
FIG. 5 is a fragmentary elevational view of the hammer, latch, and trigger shown in their neutral positions.
Figure 6:
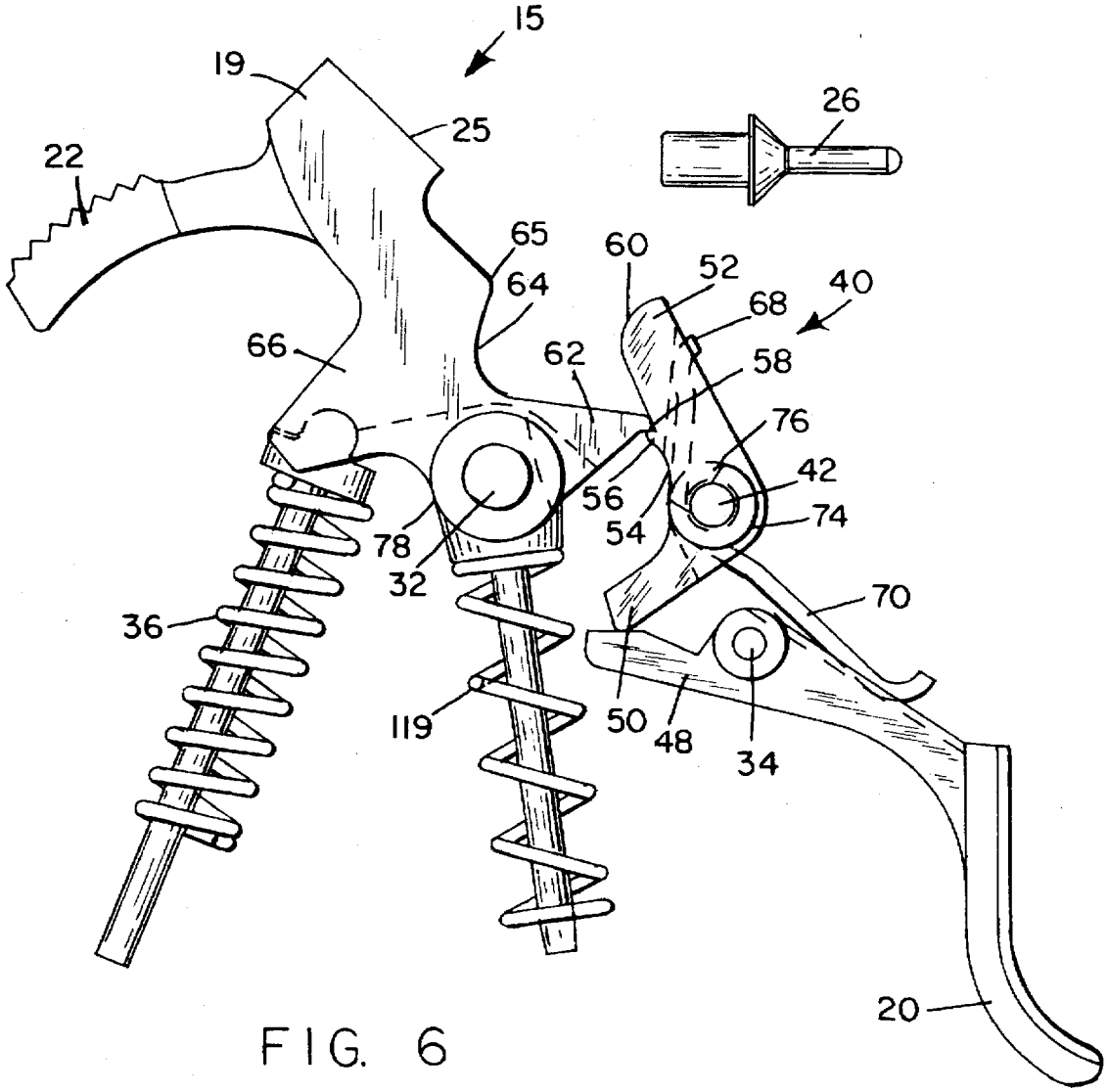
FIG. 6 is a view similar to FIG. 5 showing the hammer, latch, and trigger in their cocked positions.
Figure 7:
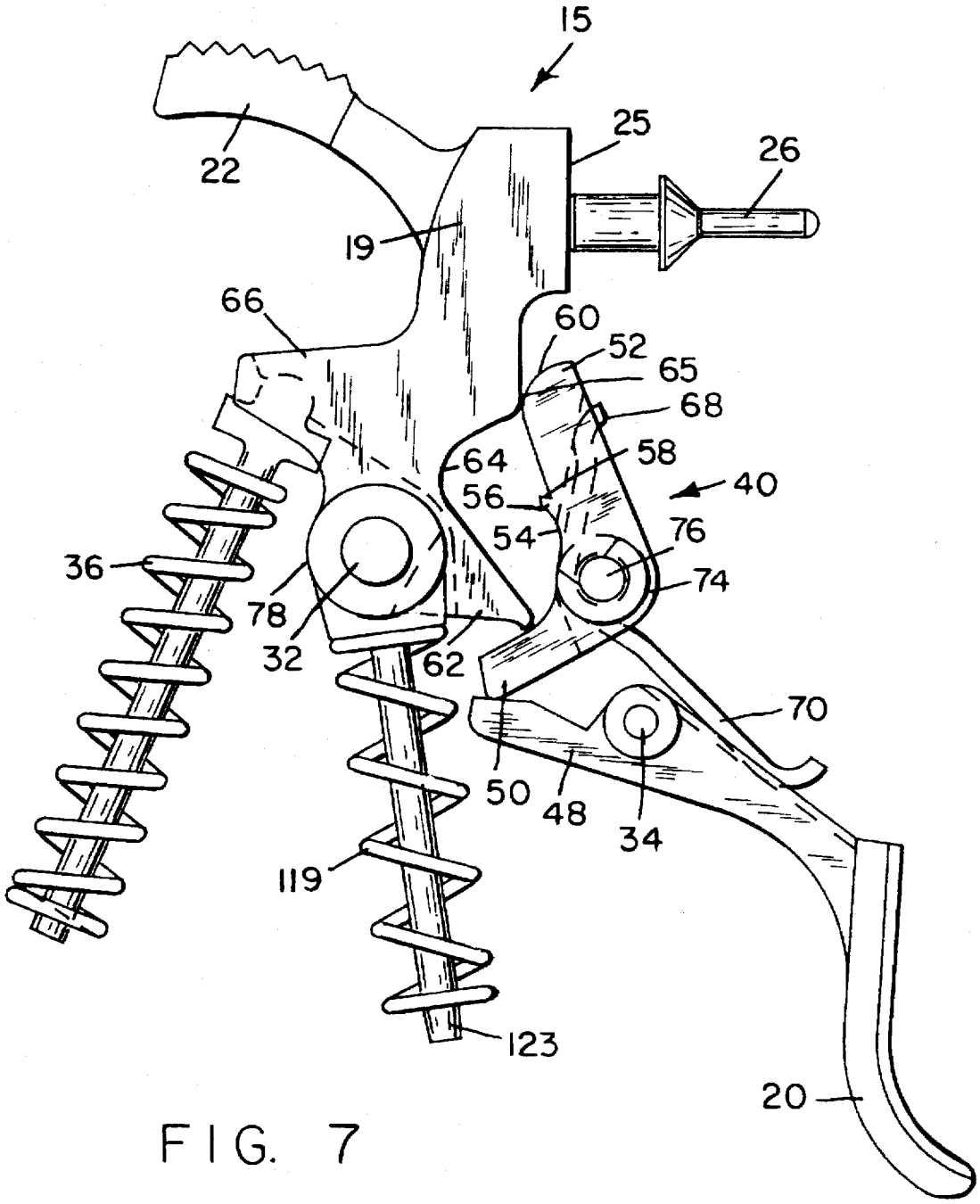
FIG. 7 is view similar to FIG. 5 showing the hammer, latch, and trigger in their firing positions.

Referring particularly to FIGS. 5–7, the trigger 20 has a rearwardly extending actuating finger 48. The latch 40 is a bell crank lever having a lower arm 50 and upper arm 52. The latch 40 has a rearwardly facing surface 54 and a projection 56 which extends rearwardly from the surface 54. The projection 56 has an upwardly facing surface 58. The outer end of the latch 40 has a rounded convex surface 60. The lower end of the hammer 19 has a forwardly extending catch finger 62. The hammer 19 has a forwardly facing intermediate concave surface 64 which is located between the catch finger 62 and the striker surface 25. The hammer 19 has a convex surface 65 between the intermediate surface 64 and the striker surface 25. The hammer 19 has a rearwardly projecting arm 66 which is connected to the spring 36.

The hammer 19 is normally in its neutral position, as shown in FIG. 5, wherein the convex surface 60 of the latch 40 engages the concave intermediate surface 64 of the hammer. The latch 40 functions as a hammer block for maintaining the hammer 19 in its intermediate position against the bias of the spring 36. A tension spring 68 mounted on the pivot pin 42 biases the upper arm 52 toward the concave surface 64 of the hammer 19. The lower arm 50 engages the actuating finger 48 of the trigger 20 to maintain the trigger in its neutral position, as shown in FIG. 5. A torsion spring 70, which in the preferred embodiment is an extension of the spring 68, biases the trigger 20 for rotation in a clockwise direction, as shown in FIG. 5, to maintain the actuating finger 48 in engagement with the lower arm 50. The latch 40 has a cylindrical hub 74 which is concentric with the pivot pin 42 and which has a rearwardly facing notch 76 for a purpose to be described.

The hammer 19 is moved from its neutral position, shown in FIG. 5, to its cocked position, shown in FIG. 6, by applying downward pressure to the thumb grip 22, thereby causing the hammer 19 to rotate in a counterclockwise direction about the pivot pin 32. As the hammer 19 moves from its neutral position to its cocked position, the catch finger 62 engages the rearwardly facing surface 54 of the latch 40 and rotates the latch 40 in a clockwise direction against the bias of the spring 68 until the catch finger passes by the projection 56 and engages the upwardly facing surface 58 of the catch. At this point, the springs 36 and 68 are essentially opposing one another. In addition, the catch finger 62 is biased toward the pivot pin 42 and the point of the rearwardly facing surface 54 which engages the end of the catch finger 62 is biased toward the pin 32. This locks the hammer 19 in its cocked position. The spring 70 maintains the actuating finger 48 of the trigger in engagement with the lower arm 50 of the catch. However, the biasing force of the spring 70 is relatively weak and far less than that which is required to rotate the latch 40 in a clockwise direction about the pivot pin 42. The trigger 20, as shown in FIG. 6, in its cocked position, ready to be manually actuated to release the hammer 19 to its firing position. When the hammer is in its cocked position, the latch 40 functions as a sear.

The hammer 19 is released in its cocked position, shown in FIG. 6, to its firing position, shown in FIG. 7, by manually pulling back on the trigger 20 to rotate the trigger 20 in a clockwise direction as viewed in FIG. 7. This motion of the trigger 20 causes the actuating finger 48 to move upwardly which, in turn, pushes the lower arm 50 upwardly and causes the latch 40 to rotate in a clockwise direction as viewed in FIG. 7. Rotation of the latch 40 in a clockwise direction moves the upper surface 58 of the projection 56 out of engagement with the end of the catch finger 62, thereby releasing the hammer 19 to its firing position, as shown in FIG. 7, under the biasing action of the spring 36. As the hammer 19 moves to its firing position, the striker surface 25 engages the rearwardly extending end of the firing pin 26 and forces the forward end of the firing pin 26 into a cartridge which is located within the receiver 27, thereby discharging the firearm. When the trigger 20 is released, the convex surface 60 of the catch engages the convex surface 65 of the hammer and through the biasing effect of the spring 68 rotates the hammer 19 in a counterclockwise direction, as viewed in FIG. 7, about the pivot pin 32 against the biasing effect of the spring 36. At this point, the biasing force of the spring 68 is at its greatest value and the biasing force of the spring 36 is at its weakest value. As the hammer 19 is pushed rearwardly by the upper arm 52, the rounded end 60 of the upper arm slips into the concave intermediate surface 64 of the hammer to lock the hammer in its intermediate position, as shown in FIG. 5. As latch 40 rotates in a counterclockwise direction, as viewed in FIGS. 5 and 7, the lower arm 50 of the latch engages the actuating finger 48 of the trigger and causes the trigger to rotate counterclockwise about its pivot pin 34. This positions the trigger in its intermediate position, as shown in FIG. 5. It is clear from the above description that the latch 40 functions as a hammer block and a sear. When the hammer 19 is in the intermediate position, as shown in FIG. 5, the latch 40 functions as a hammer block. The hammer 19 is prevented from moving to the firing position by the latch 40 and the trigger is prevented from moving to the firing position. Because of the geometry of the trigger and latch and the locations of their respective pivot pins, the latch 40 cannot be moved by the actuating finger 48 regardless of how much rearward pressure is applied to the trigger 20. The latch 40 functions as a sear when the trigger 20 and the hammer 19 are in their respective cocked positions, as shown in FIG. 6, wherein movement of the trigger 20 to its firing position is effective to cause the latch 40, in its role as a sear, to release the hammer 19 to its firing position. Immediately thereafter, the latch 40 again assumes its role as a hammer block.

HAMMER LOCK MECHANISM

Figure 8:
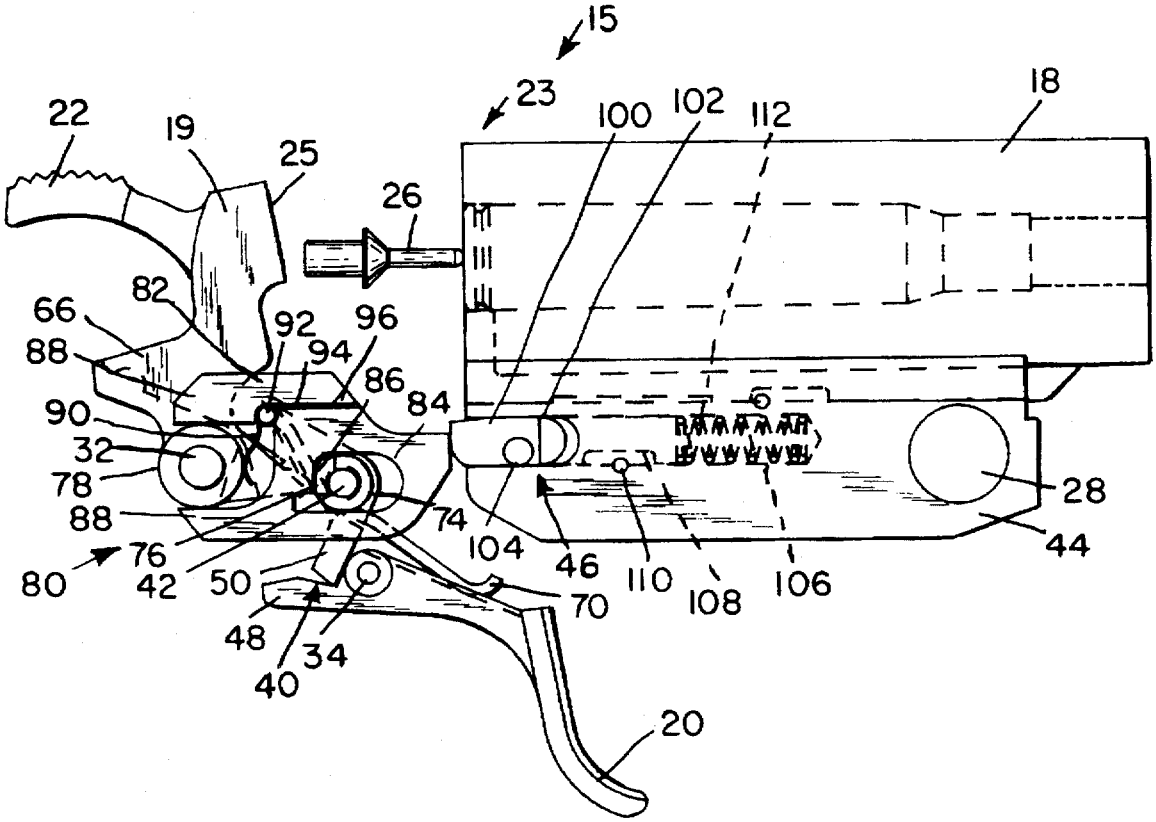
FIG. 8 is a fragmentary side elevational view, showing the hammer, latch, and trigger and an interlock system for preventing the hammer from being cocked when the barrel is in its opened position, the hammer being shown in its neutral positions.

Referring to FIGS. 8 and 9, there is shown a hammer locking mechanism which includes a locking key, generally indicated by the reference numeral 80. The locking key 80 comprises a flat plate 82 which has a slot 84 at the forward end of the plate and a pair of rearwardly facing spaced arms 88. The latch 40 has a cylindrical boss 74 which extends into the slot 84. The rear end of the slot 84 has a forwardly facing first locking profile in the form of a protrusion 86. The spaced arms 88 straddle a cylindrical boss 78 which is fixed to the hammer 19 and which is concentric with the central longitudinal axis of the pin 32. The flat plate 82 is slidably mounted on the bosses 74 and in 78 for movement between a rearward unlocking position, shown in FIG. 8, to a forward locking position, shown in FIG. 9. When the flat plate 82 is in its forward position, as shown in FIG. 9, protrusion 86 fits into the notch 76. The notch 76 constitutes a second locking profile which mates with the first locking profile represented by the protrusion 86. When the first and second lock profiles are engaged, the latch 40 is prevented from rotating about the central longitudinal axis of the pivot pin 42. When the latch 40 is thereby locked against rotation about the pivot pin 42 by the locking key 80, the latch, in turns, locks the hammer 19 against rotation about the pivot pin 32 so that the hammer cannot be moved to its cocked position. The flat plate 82 is biased to its forward locking position by a L-shaped spring which is mounted in a fixed position on a pin 92 which is mounted on the flat plate 82. The L-shaped spring has a first arm 90 which engages the cylindrical boss 78 of the hammer block and a second arm 94 which lies in a groove 96 of the flat plate 82. The spring arm 90 biases the flat plate 82 so that the protrusion 86 is in locking engagement with the notch of the boss 74. When the flat plate 82 is in its rearward position, as shown in FIG. 8, protrusion 86 is clear of the notch 76 of the boss 74 so that the latch 40 is free to rotate about its pivot pin 42, thereby enabling the hammer 19 to be moved to its cocked position.

The flat plate 82 is maintained in its outer or unlocked position by the releasable catch mechanism 46 which also functions to maintain the barrel 18 in its closed position. This function of the catch mechanism is described more fully in the next section under the heading "BARREL LOCK MECHANISM". The releasable catch mechanism 46 includes a locking bolt 100 which is slidably mounted in a slot 102 and a bore 106 in the subhousing 44 of the barrel 18. A pin 104 extends laterally from the locking bolt 100. The locking bolt is biased outwardly against the flat plate 82 by a compression spring 106 which is located within the bore 112. The biasing force of the spring 112 is greater than the biasing force of the arm 90 of the L-shaped spring which is mounted on the flat plate 82 so that the flat plate 82 is normally maintained in its outer or unlocked position by the locking bolt 100. When the barrel 18 is pivotal about the pivot pin 28 so that the breech end 23 of the barrel 18 is moved to its open position, as shown in FIG. 9, the locking bolt 100 moves out of contact with the flat plate 82. This enables the spring arm 90 to move the plate 82 inwardly to the locked position, wherein the protrusion 86 (first locking profile) engages the notch 76 (second locking profile) of the cylindrical boss 74. The hammer 19 is, thereby, prevented from being moved to the cocked position when the breech end 23 of the barrel is in the open position, as shown in FIG. 9. The subhousing 44 also contains a conventional cartridge extractor 114 which moves to its outer cartridge extracting position, as shown in FIG. 9, for extracting an empty cartridge when the breech end of the barrel is opened after the cartridge has been fired. When the breech end of the barrel is in the open position, as shown in FIG. 9, the locking bolt 100 is moved rearwardly or outwardly by the spring 112. The outermost position of the locking bolt 100 is being determined by a stop pin 110 which is fixed to the subhousing 44 and which is positioned within a notch 108 in the locking bolt 100. The outer position of the locking bolt 100 is reached when the inner or forward end of the notch 108 reaches the stop pin 110, as shown in FIG. 9. As long as the breech end 23 of the barrel is in the open position, as shown in FIG. 9, the flat plate 82 remains in its locking position and the hammer 19 is prevented from being moved to its cocked position.

BARREL LOCK MECHANISM

Figure 10:
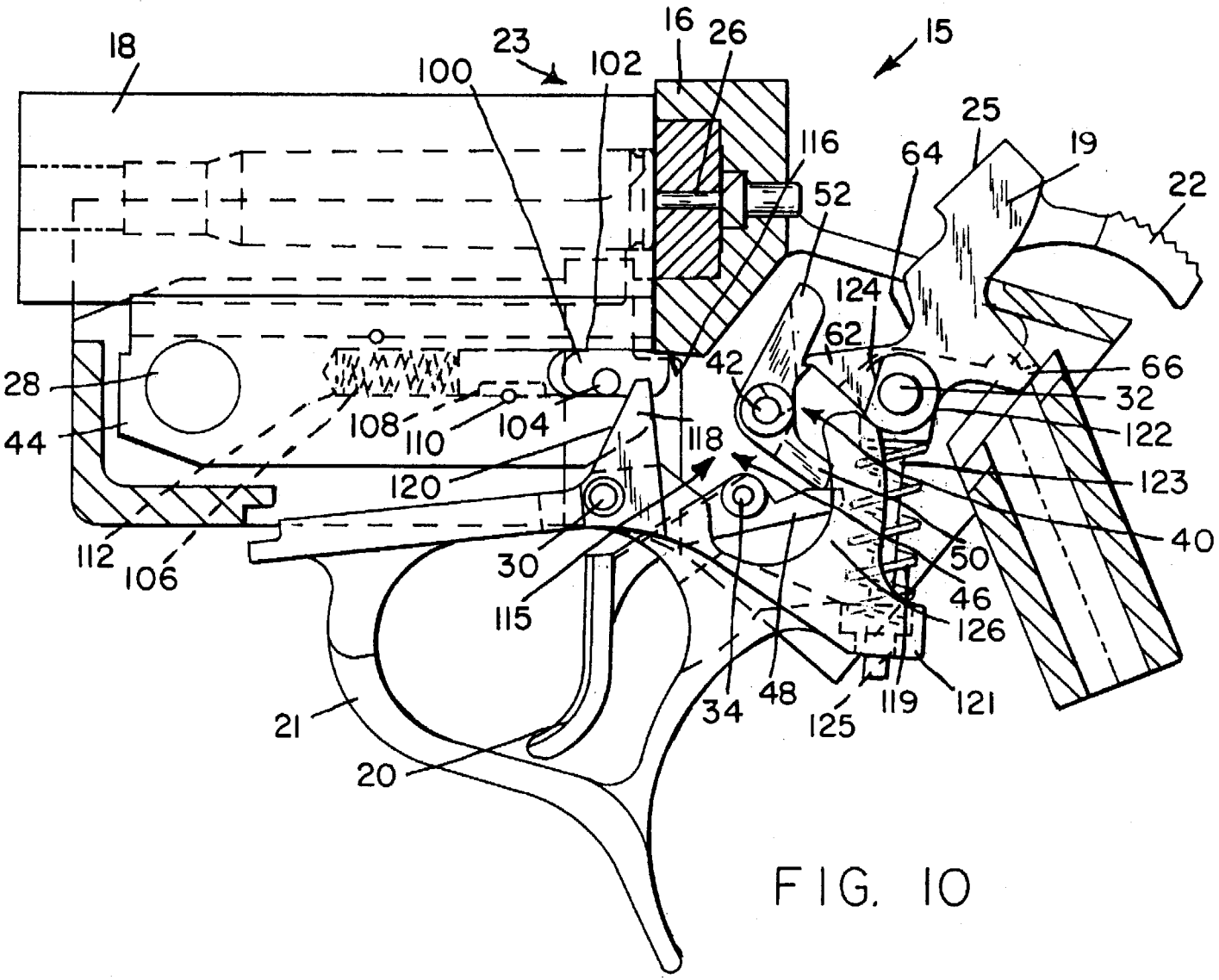
FIG. 10 is a fragmentary side elevation view with a second locking means for preventing the barrel from being moved to its open position when the hammer is in its cocked positions.
Figure 11:
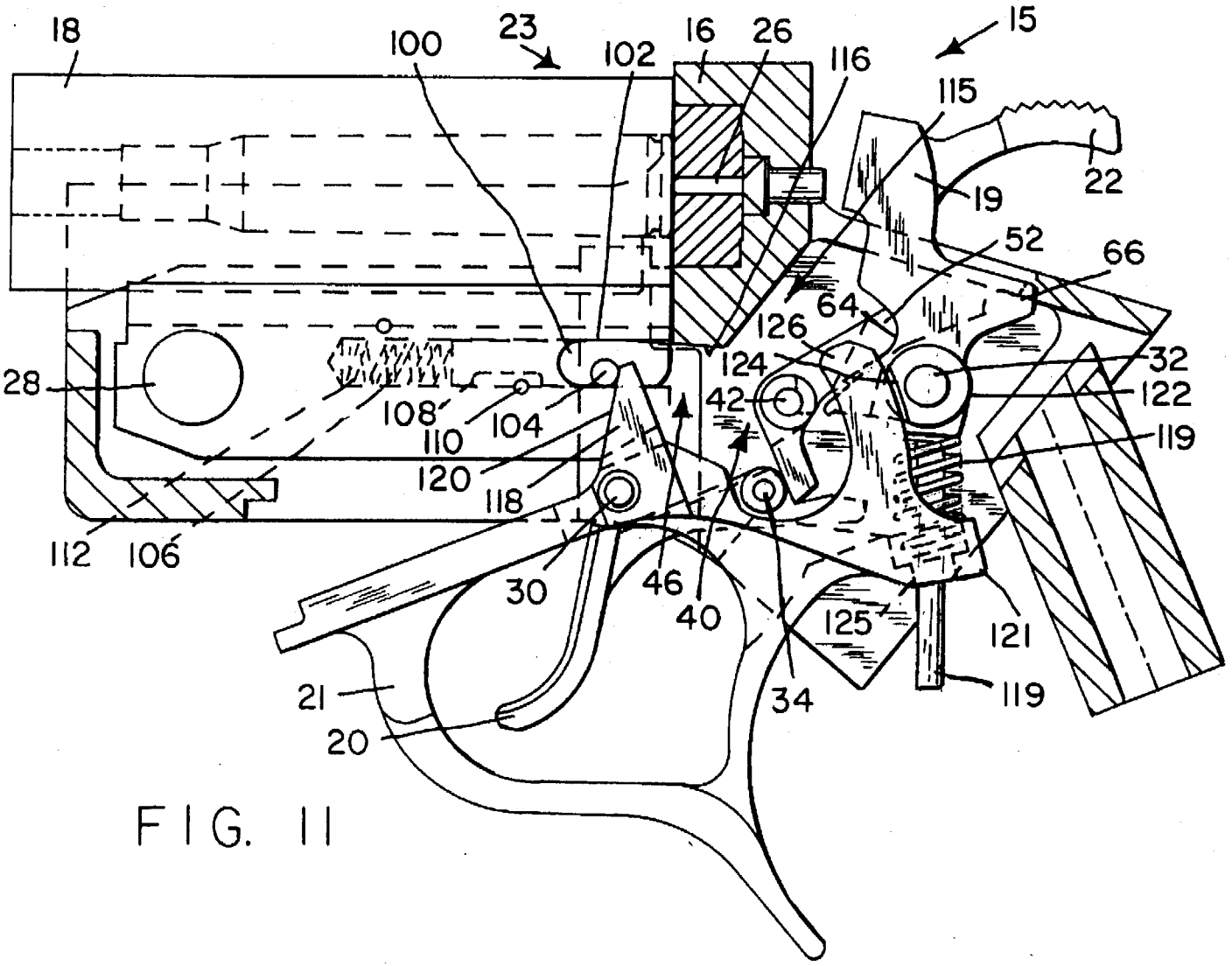
FIG. 11 is a view similar to FIG. 10, showing the barrel in its closed position but free to be moved to its open position while the hammer is in its neutral position.
Figure 12:
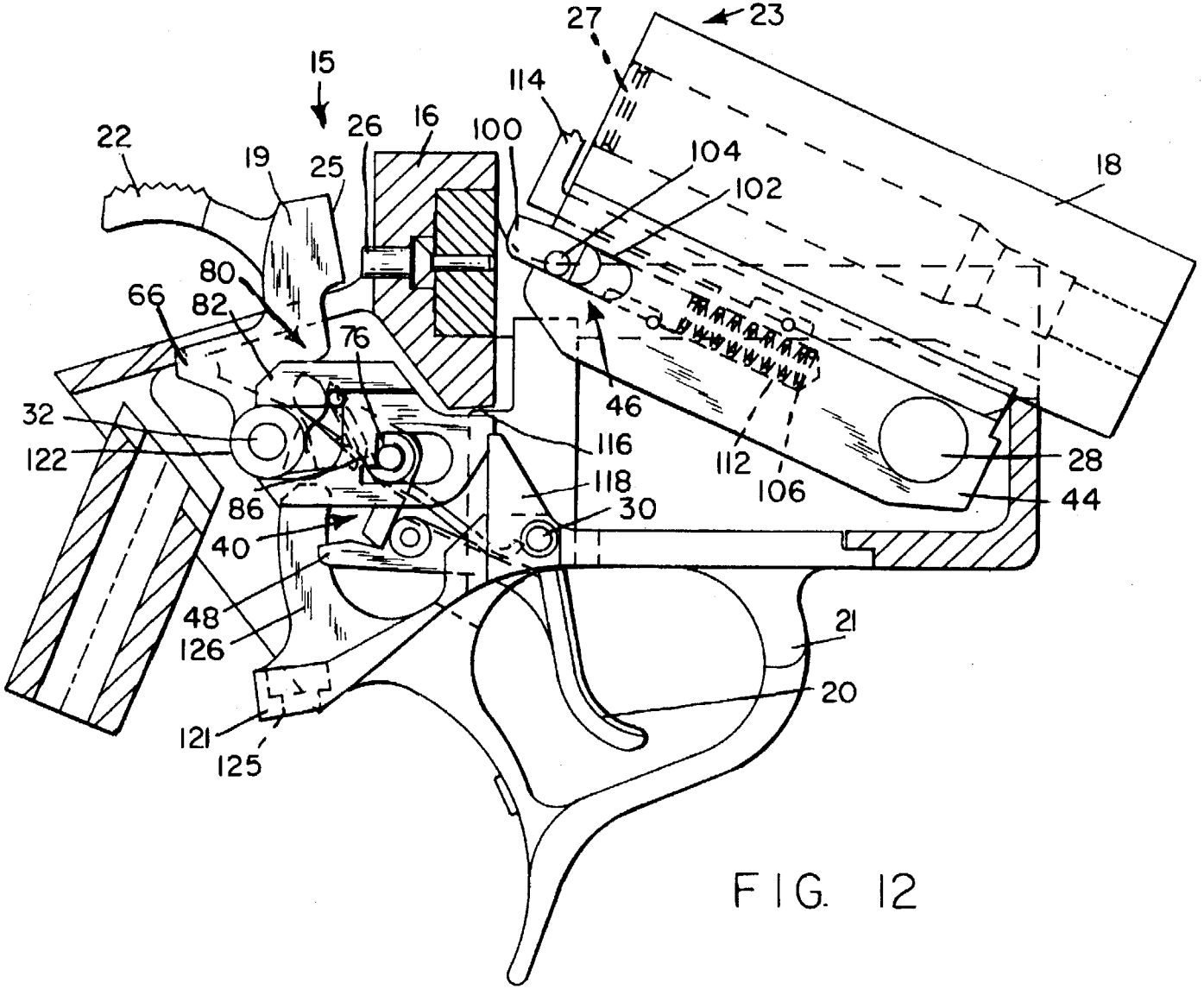
FIG. 12 is a view similar to FIG. 11, showing the barrel in its open position while the hammer is in its neutral position.

Referring particular to FIGS. 10 and 11, them is shown a barrel locking mechanism, generally indicated by the reference numeral 115, for preventing the barrel 18 from being moved to its open position when the hammer block is in its cocked position. The barrel lock mechanism 115 includes the previously described releasable catch mechanism 46 and a protuberance 126 which is fixed to and extends upwardly from the trigger guard 21. The hammer 19 has a cylindrical boss 122 which is concentric about the central longitudinal axis of the pivot pin 32. The boss 122 has a forwardly facing relief 124. The locking bolt 100 normally extends under a downwardly facing surface 116 of a portion of the frame which houses the firing pin 26, commonly referred to as the "standing breech". This prevents the barrel 18 from routing about the pivot pin 28 to swing the breech end 23 of the barrel to its open position. The locking bolt 100 is moved forwardly to its release position by the trigger guard 21 when the trigger guard is pivoted to its open position about the pivot pin 30. The trigger guard 21 has an upwardly extending release finger 118 that has a forwardly facing cam surface 120. The trigger guard 21 is maintained in its closed position as shown in FIG. 12 by a compression spring 119 which extends from a rearwardly extending arm 121 of the trigger guard to the bottom of the hammer 19. A guide rod 123 is fixed to the bottom of the hammer 19 and extends freely through an aperture 125 in the arm 121.

When the trigger guard 21 is moved to its open position as viewed in FIG. 11, the cam surface 120 of the release finger 118 engages the pin 104 and moves the locking bolt 100 forwardly so that it is clear of the downwardly facing surface 116. This enables the barrel 18 to be pivoted about pivot pin 30 so that the breech end of the barrel is in its open position as shown in FIG. 12.

When the hammer 19 is in its neutral position, as shown in FIG. 11, the relief 124 is aligned with the path of travel of the protuberance 126 when the trigger guard 21 is pivoted about the pivot pin 30 to its open or releasing position. This enables the protuberance 126 to clear the boss 122 and allows the forwardly facing surface 120 of the release finger 118 to engage the pin 104 as the trigger guard 21 is rotated to the open position as shown in FIG. 11. The locking bolt 100 is pushed forwardly against the bias of the spring 106 so that it no longer protrudes beyond the end of the breech end of the barrel and is clear of the downwardly facing surface 116 of the frame 16. At this point, the barrel 18 can be pivoted to its open position, as shown in FIG. 12. When the hammer 19 is in its cocked position, as shown in FIG. 10, the relief 124 is out of alignment with the path of travel of the protuberance 126. As the trigger guard 21 is pivoted about the pivot pin 30, the upper end of the protuberance 126 engages the boss 122 to prevent the trigger guard 21 from pivoting sufficiently to enable the forwardly extending surface 120 from engaging the pin 104. The trigger guard 21 is prevented from moving the locking bolt 100 to its release position, thereby preventing the barrel from being pivoted to its open position.

Clearly minor changes may be made in the form and construction of the invention without departing from the material spirit thereof. It is not, however, desired to confine the invention to the exact form herein shown and described, but is desired to include as such as properly covered in the scope claimed.

Invention having been thus described, what is claimed is new and desired to secure by Letters Patent is:

1. A firearm comprising:

(a) a frame;

(b) a barrel pivotally mounted on the frame, said barrel having a muzzle end and a breech end;

(c) a firing pin mounted on the frame adjacent the breech end of the barrel;

(d) a hammer pivotally mounted on the frame, said hammer having an upper forwardly facing striker surface, a lower forwardly extending catch finger and a forwardly facing intermediate surface which is located between said striker surface and said finger, said hammer having a firing position in which said striker surface is in engagement with the firing pin, a cocked position in which said striker surface is spaced from the firing pin, and a neutral position in which said striker is between the firing position and the cocked position;

(e) a hammer spring for biasing the hammer toward the firing position;

(f) a trigger pivotally connected to the frame, said trigger having a firing position, a neutral position which is spaced from said firing position and a cocked position which is between said firing position and said neutral position, said trigger having an actuating finger projecting from said trigger;

(g) a latch pivotally mounted on the frame between said hammer and said trigger, said latch having an upper arm and a lower arm, said lower arm and said upper arm forming a bell-crank lever, said upper arm having a rearward side which has an upwardly facing latch surface, said latch surface being in engagement with said catch finger when said hammer and said trigger are in their respective cocked positions for releasably maintaining said hammer in its cocked position, said lower arm engaging said actuating finger so that when said trigger is moved from its cocked position to its firing position, said latch is rotated sufficiently by said actuating finger to move said latch surface out of engagement with said catch finger for releasing said hammer and allowing said hammer to move to its firing position, said upper finger engaging the intermediate surface of said hammer when said hammer is in its neutral position for maintaining said hammer in its neutral position, said catch finger being effective to rotate said latch when said hammer is manually moved to its cocked position so that said catch finger engages said latch surface and said lower arm causes said trigger to rotate from its neutral position to its cocked position; and a latch spring for biasing the upper finger of said latch toward said intermediate surface and for forcing said hammer from its firing position to its neutral position against the bias of said hammer spring, wherein said upper finger engages said intermediate surface.

2. A firearm as recited in claim 1, wherein said intermediate surface is concave and the portion of said upper finger which engages said intermediate surface is convex.

3. A firearm as recited in claim 2, wherein said hammer has a forwardly facing convex cam surface between said striker surface and said intermediate surface which is engaged by said upper arm when said hammer is in its firing position for moving said hammer to its neutral position in the absence of rearward manual pressure on said trigger when said trigger is in its firing position.

4. A firearm as recited in claim 1, wherein said intermediate surface contacts said upper finger at a point on said upper finger which is substantially on a line which intersects the pivoting axis of said latch.

5. A firearm as recited in claim 1, wherein said barrel is pivotally mounted on said frame for pivoting about a first horizontal axis near said breech end between a closed position and an open position, and said firearm further comprises:

(a) a downwardly facing surface fixed to said frame and facing the breech end of said barrel;

(b) a catch slidingly mounted on said barrel at said breech end for movement between a locking position in which said catch engages said downwardly facing surface for maintaining said barrel in said closed position and a release position in which said catch is out of engagement with said protuberance to enable said barrel to be moved to said open position;

(c) a catch spring for biasing said catch to its locking position;

(a) a trigger guard pivotally mounted on said frame for pivoting about a second horizontal axis adjacent said breech end for pivoting movement between an open position and a closed position;

(e) release means operatively connected to said trigger guard and to said catch for moving said catch to its release position when said trigger guard is moved to its open position to enable said barrel to be moved to its open position;

(f) a stop fixed to said hammer, said stop occupying a blocking position when said hammer is in its cocked position and said stop occupying a clear position when said hammer is in its neutral position; and (g) a protuberance fixed to said trigger guard, said protuberance extending upwardly for engaging said stop when said stop is in its blocking position and said trigger guard is moved from its closed position toward its open position to prevent said trigger guard from reaching its open position and thereby preventing said barrel from being moved to its open position.

6. A firearm as recited in claim 5, wherein said stop is a cylindrical boss which is coaxial with the pivoting axis of said hammer, said cylindrical boss having an outer cylindrical surface which intersects the path of travel of said protuberance when said hammer is in its cocked position and said trigger guard is moved to its open position, said cylindrical boss having a relief in said cylindrical surface, said relief occupying the path of travel of said protuberance for allowing said protuberance to pass clear said cylindrical boss and to allow said trigger guard to be moved to its open position.

7. A firearm as recited in claim 5, wherein said barrel has a bore which has an end opening at the breech end of said barrel wherein said catch is a locking bolt which is slidingly mounted in said bore so that said locking bolt is substantially within said bore when said catch is in its release position and at least a portion of said locking bolt extends outside of said end opening when said catch is in its locking position.

8. A firearm as recited in claim 7, wherein said catch spring is a coil spring located in said bore so that said locking bolt is between said coil spring and said end opening.

9. A firearm as recited in claim 7, wherein said release means comprises:

(a) a pin fixed to said locking bolt and extending laterally from said locking bolt; and (b) a release finger fixed to said trigger guard and extending upwardly from said trigger guard, said release finger having a forwardly facing cam surface for engaging said pin when said trigger guard is moved toward its open position for moving said locking bolt away from said end opening.

10. A firearm as recited in claim 1, wherein said barrel is pivotally mounted on said frame for pivoting about a horizontal axis near said breech end between a closed position and an open position, and said firearm further comprises:

(a) first locking means operatively connected to said barrel and to said hammer for preventing said barrel from moving to its open position when said hammer is in its cocked position; and (b) second locking means operatively connected to said barrel and to said hammer for preventing said hammer from moving to its cocked position when said barrel is in its open position.

11. A firearm as recited in claim 1, wherein said barrel is pivotally mounted on said frame for pivoting about a first horizontal axis near said breech end between a closed position and an open position, and said firearm further comprises:

(a) a locking key operatively connected to one of said hammer, said trigger and said latch and mounted for movement relative to said frame between a neutral position in which said hammer is free to move to its cocked position and a locking position in which said hammer is prevented from moving to its cocked position;

(b) a key spring for biasing said locking key to its locking position; and (c) a key actuator operatively connected to said locking key and to said barrel for maintaining said locking key is in its neutral position when said barrel is in its closed position against the bias of said key spring and for enabling said locking key to move to its locking position when said barrel is its open position to prevent said hammer from moving to its cocked position when said barrel is in its open position.

12. A firearm as recited in claim 11, wherein said locking key is operatively connected to said latch, said locking key comprises a flat plate which has a horizontal slot having a forward end and a rearward end and a first locking profile at the rearward end of the slot, said latch having a cylindrical boss fixed to said latch and coaxial with the pivoting axis of said latch, said boss having a rearwardly facing second locking profile which is complementary to said first locking profile, said boss extending horizontally through said slot so that said locking key is slidingly mounted on said boss for movement along a sliding axis, said locking key having guide means for preventing said flat plate from moving in any direction except said sliding axis, said flat plate being biased forwardly by said key spring so that said first locking profile engages said second locking profile to prevent said latch from rotating about its pivoting axis when said locking key is in its locking position.

13. A firearm as recited in claim 12, wherein one of said first and second locking profiles is a projection and the other of said first and second locking profiles is a notch for receiving said projection.

14. A firearm as recited in claim 12, wherein said flat plate has a horizontal guide slot, and said guide means comprises a cylindrical pin on said hammer said cylindrical pin being concentric with the pivoting axis of said hammer and extending laterally through said guide slot.

15. A firearm comprising:

(a) a frame;

(b) a barrel having a breech end and a muzzle end said barrel being pivotally mounted on the frame for pivoting about a first horizontal axis near said breech end between a closed position and an open position;

(c) a firing pin mounted on the frame adjacent the breech end of the barrel;

(d) a hammer pivotally mounted on the frame for pivoting about a second horizontal axis, said hammer having an upper forwardly facing striker surface, said hammer having a firing position in which said striker surface is in engagement with the firing pin, and a cocked position in which said striker surface is spaced from the firing pin;

(e) a hammer spring for biasing the hammer toward its firing position;

(f) a trigger pivotally connected to the frame, said trigger having a firing position, and a cocked position which is spaced from its firing position;

(g) latch means operatively connected to said hammer and to said trigger for positioning said trigger in its cocked position when said hammer is in its cocked position and for releasably maintaining said hammer in its cocked position, and for releasing said hammer to its firing position upon manual movement of said trigger to its firing position;

(h) a downwardly facing surface fixed to said frame and facing the breech end of said barrel;

(i) a catch slidingly mounted on said barrel at said breech end for movement between a locking position in which said catch engages said downwardly facing surface for maintaining said barrel in said closed position and a release position in which said catch is out of engagement with said protuberance to enable said barrel to be moved to said open position;

(j) a catch spring for biasing said catch to its locking position;

(k) a trigger guard pivotally mounted on said frame for pivoting about a second horizontal axis adjacent said breech end for pivoting movement between an open position and a closed position;

(l) release means operatively connected to said trigger guard and to said catch for moving said catch to its release position when said trigger guard is moved to its open position to enable said barrel to be moved to its open position;

(m) a stop fixed to said hammer, said stop occupying a blocking position when said hammer is in its cocked position, said stop occupying a clear position when said hammer is in its neutral position; and (n) a protuberance fixed to said trigger guard, said protuberance extending upwardly for engaging said stop when said stop is in its blocking position and said trigger guard is moved from its closed position toward its open position to prevent said trigger guard from reaching its open position and thereby preventing said barrel from being moved to its open position.

16. A firearm as recited in claim 15, wherein said stop is a cylindrical boss which is coaxial with the pivoting axis of said hammer, said cylindrical boss having an outer cylindrical surface which intersects the path of travel of said protuberance when said hammer is in its cocked position and said trigger guard is moved to its open position, said cylindrical boss having a relief in said cylindrical surface, said relief occupying the path of travel of said protuberance for allowing said protuberance to pass clear said cylindrical boss and to allow said trigger guard to be moved to its open position.

17. A firearm as recited in claim 15, wherein said barrel has a bore which has an end opening at the breech end of said barrel wherein said catch is a locking bolt which is slidingly mounted in said bore so that said locking bolt is substantially within said bore when said catch is in its release position and at least a portion of said locking bolt extends outside of said end opening when said catch is in its locking position.

18. A firearm as recited in claim 17, wherein said catch spring is a coil spring located in said bore so that said locking bolt is between said coil spring and said end opening.

19. A firearm as recited in claim 17, wherein said release means comprises:

(a) a pin fixed to said locking bolt and extending laterally from said locking bolt; and (b) a release finger fixed to said trigger guard and extending upwardly from said trigger guard, said release finger having a forwardly facing cam surface for engaging said pin when said trigger guard is moved toward its open position for moving said locking bolt away from said end opening.

20. A firearm as recited in claim 15, wherein said latch means includes a latch lever pivotally mounted on said frame, and wherein said firearm further comprises:

(a) a locking key operatively connected to one of said hammer, said trigger and said latch lever and mounted for movement relative to said frame between a neutral position in which said hammer is free to move to its cocked position and a locking position in which said hammer is prevented from moving to its cocked position;

(b) a key spring for biasing said locking key to its locking position; and (c) a key actuator operatively connected to said locking key and to said barrel for maintaining said locking key is in its neutral position when said barrel is in its closed position against the bias of said key spring and for enabling said locking key to move to its locking position when said barrel is in its open position to prevent said hammer from moving to its cocked position when said barrel is in its open position.

21. A firearm as recited in claim 20, wherein said locking key is operatively connected to said latch lever, said locking key comprises a flat plate which has a horizontal slot having a forward end and a rearward end and a first locking profile at the rearward end of the slot, said latch lever having a cylindrical boss fixed to said latch lever and coaxial with the pivoting axis of said latch lever, said boss having a rearwardly facing second locking profile which is complementary to said first locking profile, said boss extending horizontally through said slot so that said locking key is slidingly mounted on said boss for movement along a sliding axis, said locking key having guide means for preventing said flat plate from moving in any direction except said sliding axis, said flat plate being biased forwardly by said key spring so that said first locking profile engages said second locking profile to prevent said latch lever from rotating about its pivoting axis when said locking key is in its locking position.

22. A firearm as recited in claim 21, wherein one of said first and second locking profiles is a projection and the other of said first and second locking profiles is a notch for receiving said projection.

23. A firearm as recited in claim 21, wherein said flat plate has a horizontal guide slot, and said guide means comprises a cylindrical pin on said hammer said cylindrical pin being concentric with the pivoting axis of said hammer and extending laterally through said guide slot.

24. A firearm comprising:

(a) a frame;

(b) a barrel having a breech end and a muzzle end said barrel being pivotally mounted on the frame for pivoting about a first horizontal axis near said breech end between a closed position and an open position;

(c) a firing pin mounted on the frame adjacent the breech end of the barrel;

(d) a hammer pivotally mounted on the frame for pivoting about a second horizontal axis, said hammer having an upper forwardly facing striker surface, said hammer having a firing position in which said striker surface is in engagement with the firing pin, and a cocked position in which said striker surface is spaced from the firing pin;

(e) a hammer spring for biasing the hammer toward its firing position;

(f) a trigger pivotally connected to the frame, said trigger having a firing position, and a cocked position which is spaced from its firing position;

(g) latch means operatively connected to said hammer and to said trigger for positioning said trigger in its cocked position when said hammer is in its cocked position and for releasably maintaining said hammer in its cocked position, and for releasing said hammer to its firing position upon manual movement of said trigger to its firing position;

(h) first locking means operatively connected to said barrel and to said hammer for preventing said barrel from moving to its open position when said hammer is in its cocked position; and (i) second locking means operatively connected to said barrel and to said hammer for preventing said hammer from moving to its cocked position when said barrel is in its open position.

25. A firearm comprising:

(a) a frame;

(b) a barrel having a breech end and a muzzle end said barrel being pivotally mounted on the frame for pivoting about a first horizontal axis near said breech end between a closed position and an open position;

(c) a firing pin mounted on the frame adjacent the breech end of the barrel;

(d) a hammer pivotally mounted on the frame for pivoting about a second horizontal axis, said hammer having a an upper forwardly facing striker surface, said hammer having a firing position in which said striker surface is in engagement with the firing pin, and a cocked position in which said striker surface is spaced from the firing pin;

(e) a hammer spring for biasing the hammer toward its firing position;

(f) a trigger pivotally connected to the frame, said trigger having a firing position, and a cocked position which is spaced from its firing position;

(g) a latch lever operatively connected to said hammer and to said trigger for positioning said trigger in its cocked position when said hammer is in its cocked position and for releasably maintaining said hammer in its cocked position, and for releasing said hammer to its firing position upon manual movement of said trigger to its firing position;

(h) a locking key operatively connected to one of said hammer, said trigger and said latch lever and mounted for movement relative to said frame between a neutral position in which said hammer is free to move to its cocked position and a locking position in which said hammer is prevented from moving to its cocked position;

(i) a key spring for biasing said locking key to its locking position; and (j) a key actuator operatively connected to said locking key and to said barrel for maintaining said locking key is in its neutral position when said barrel is in its closed position against the bias of said key spring and for enabling said locking key to move to its locking position when said barrel is in its open position to prevent said hammer from moving to its cocked position when said barrel is in its open position.

26. A firearm as recited in claim 25, wherein said locking key is operatively connected to said latch lever, said locking key comprises a flat plate which has a horizontal slot having a forward end and a rearward end and a first locking profile at the rearward end of the slot, said latch lever having a cylindrical boss fixed to said latch lever and coaxial with the pivoting axis of said latch lever, said boss having a rearwardly facing second locking profile which is complementary to said first locking profile, said boss extending horizontally through said slot so that said locking key is slidingly mounted on said boss for movement along a sliding axis, said locking key having guide means for preventing said flat plate from moving in any direction except said sliding axis, said flat plate being biased forwardly by said key spring so that said first locking profile engages said second locking profile to prevent said latch lever from rotating about its pivoting axis when said locking key is in its locking position.

27. A firearm as recited in claim 26, wherein one of said first and second locking profiles is a projection and the other of said first and second locking profiles is a notch for receiving said projection.

28. A firearm as recited in claim 26, wherein said flat plate has a horizontal guide slot, and said guide means comprises a cylindrical pin on said hammer said cylindrical pin being concentric with the pivoting axis of said hammer and extending laterally through said guide slot.

* * * * *